United States Patent [19]

Volland et al.

[11] Patent Number: 4,569,376

[45] Date of Patent: Feb. 11, 1986

[54] REED WITH INCORPORATED CONFINER FOR SHUTTLELESS LOOM WITH PNEUMATIC WEFT INSERTION

[75] Inventors: Michel Volland; Pierre Rémond; Roland Boyer, all of Bourgoin-Jaillieu, France

[73] Assignee: Saurer Diederichs (Societe Anonyme), Bourgoin-Jaillieu, France

[21] Appl. No.: 621,038

[22] Filed: Jun. 15, 1984

[30] Foreign Application Priority Data

Jun. 15, 1983 [FR] France ..... 83 10272

[51] Int. Cl.[4] ..... D03D 47/28

[52] U.S. Cl. ..... 139/435

[58] Field of Search ..... 139/435, 188 R

[56] References Cited

U.S. PATENT DOCUMENTS 3,958,609 5/1976 Zollinger et al. ..... 139/435

4,192,355 3/1980 Peeler et al. ..... 139/435

FOREIGN PATENT DOCUMENTS 2043717 10/1980 United Kingdom ..... 139/435

2097025 10/1982 United Kingdom ..... 139/435

*Primary Examiner*—Henry S. Jaudon

*Attorney, Agent, or Firm*—Karl F. Ross; Herbert Dubno

[57] ABSTRACT

The loom reed (5) is formed of dents (9) defining a channel through which the weft is inserted and is drawn and guided by air jets produced by relay nozzles (3). To form the insertion channel, each dent (9) has a triangular projecting front part formed with a recess (6) opening towards the exterior at its top via an escape slit (7) slightly inclined relative to the longitudinal direction of the dent (9). The recess (6) has an offset (d) towards the front relative to the front straight edge of the dent (9). This feature is suitable for weaving threads with non-twisted, non-interlaced filaments, and enables beating-up to occur near the temples (8) after the weft thread has easily been extracted from the insertion channel via the slit (7).

6 Claims, 4 Drawing Figures

REED WITH INCORPORATED CONFINER FOR SHUTTLELESS LOOM WITH PNEUMATIC WEFT INSERTION

FIELD OF THE INVENTION

The invention relates to a reed with an incorporated confiner for a shuttleless loom with pneumatic weft insertion, i.e. a loom reed having dents formed at the front with recessed parts defining a channel through which the weft is inserted and drawn and guided by air jets produced by relay nozzles distributed all the way along the reed.

BACKGROUND OF THE INVENTION

In some known devices for pneumatically inserting the weft into a loom comprising a picking nozzle at one side, the conventional reed for separating the warp threads is associated with an auxiliary reed called a "confiner" and with relay nozzles of the type mentioned, all these components being carried by and moved with the batten.

The confiner reed defines a channel through which the weft is inserted, the relay nozzles being supplied with compressed air and contributing to draw the weft and guide it until it arrives at the opposite side of the machine from the picking nozzle.

In one device, described in French PS 81 18565 dated Sept. 28, 1981 in the name of the present applicants (publication No. 2 513 667) and shown in cross-section in FIG. 1 of the accompanying diagrammatic drawings, the confiner (1) is externally secured against one flank of the reed-bearing section member (2) and the relay nozzles (3) are held by holders (4) secured to the outer surface of the confiner (1). The confiner (1) is thus secured more closely to the reed (5) than the relay nozzles (3) are. The dents of the confiner (1) are each divided into two branches which co-operate to define a diamond-shaped recess 6, the recesses 6 of all the dents being aligned and forming a channel for inserting the weft. The dents disposed opposite the relay nozzles 3, however, omit one branch, so that the relay nozzles 3 can extend into the insertion channel in order to produce air jets therein. A slit 7 is left between the two brands of each dent of confiner 1 so that the weft thread can be released from the channel after insertion. The forward movement of the batten occurs after the weft thread has been extracted, i.e. can be very near the temples 8.

In spite of its advantages, this device has a disadvantage when weaving threads made up of untwisted filaments which are not interlaced or are only very slightly interlaced (synthetic threads). In such cases there is a risk that the filaments will become separated at the tips of the branches of the confiner dents.

In other known devices, the reed has an incorporated confiner, i.e. a confiner which forms part of the reed. In that case the dents 9 of the reed 5 have a special shape, a known example of which is shown in FIG. 2. Each dent facing the relay nozzles 3 has is defined between two e.g. triangular projecting parts between which a U-shaped recess 6 is formed substantially half way up the reed. This eliminates the sharp parts which might catch the weft threads, but the insertion channel has a wide opening at the top, resulting in a high consumption of compressed air, and the beating-up point is removed to a greater distance from the temples 8.

OBJECTS OF THE INVENTION

It is an object of the invention to provide a novel device comprising the advantages of the aforementioned techniques without their disadvantages.

A more specific object is to provide a device suited for weaving threads made of non-twisted non-interlaced filaments, but such that beating-up occurs near the temples after the weft thread has easily been extracted from the insertion channel, the device also reducing the consumption of compressed air.

To this end, in the reed with incorporated confiner according to the invention, each dent of the reed has a single approximately triangular projecting front part formed with a recess opening upwards via a part having an escape edge at a slight inclination relative to the longitudinal direction of the dent, the recess having an offset towards the front relative to the front straight edge of the dent.

Advantageously, the projecting part of each dent formed with a recess is situated at the bottom half of the dent.

In a preferred embodiment of the invention, the projecting part of each dent has a recess which is almost entirely closed, the recess opening upwards via a narrow slit formed at a point on the dent at a slight inclination relative to the longitudinal direction of the dent. In some dents, the normally solid part at the front of the dent between the recess and the aforementioned slit can be eliminated to provide space for the end of a relay nozzle.

The resulting insertion channel is almost completely closed, its cross-section being approximately as shown in FIG. 1, but is incorporated in the reed by the approach used in FIG. 2, thus avoiding delimiting the channel by pointed formations offset relative to the reed dents, since these might catch the warp threads. The insertion channel has a generally closed shape which reduces the consumption of compressed air. The channel communicates with the exterior via a suitably-oriented narrow gap, so that the weft thread can be extracted during the forward movement of the batten. In addition, since the channel is offset foward relative to the plane containing the front straight edges of the dents, the beating-up of the weft thread occurs near the temples.

According to another embodiment of the invention, the projecting part of each dent has a recess widely open towards the top and bounded by a bottom edge substantiall perpendicular to the longitudinal direction of the dent and by an escape edge having a slight inclination relative to the longitudinal direction of the dent. Although less advantageous with regard to the consumption of compressed air, this latter embodiment still retains the advantage of extracting the weft thread before beating up, during the forward motion of the batten, as a result of the inclined escape edge.

BRIEF DESCRIPTION OF THE DRAWING

In any case, the invention will be more clearly understood from the following description with reference to the accompanying diagrammatic drawing which, by way of non-limitative example, shows two embodiments of the reed with incorporated confiner according to the invention as well as prior art structures presently described. In the drawing.

SPECIFIC DESCRIPTION

Figure 1:
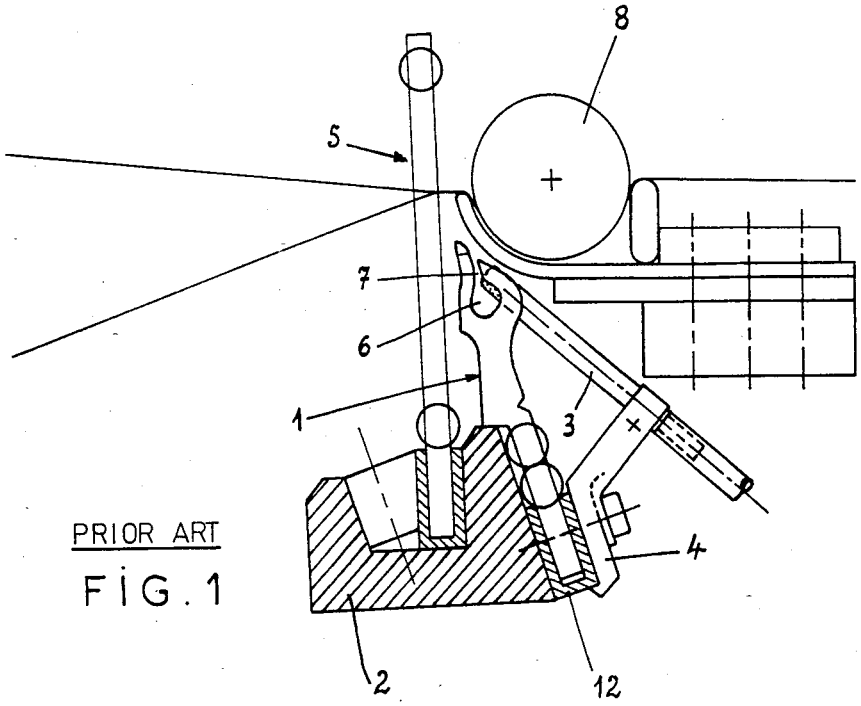
PRIOR ART FIG. 1
FIGS. 1 and 2 are the previously described sections illustrating prior art reed arrangements for pneumatic weft insertion looms.
Figure 2:
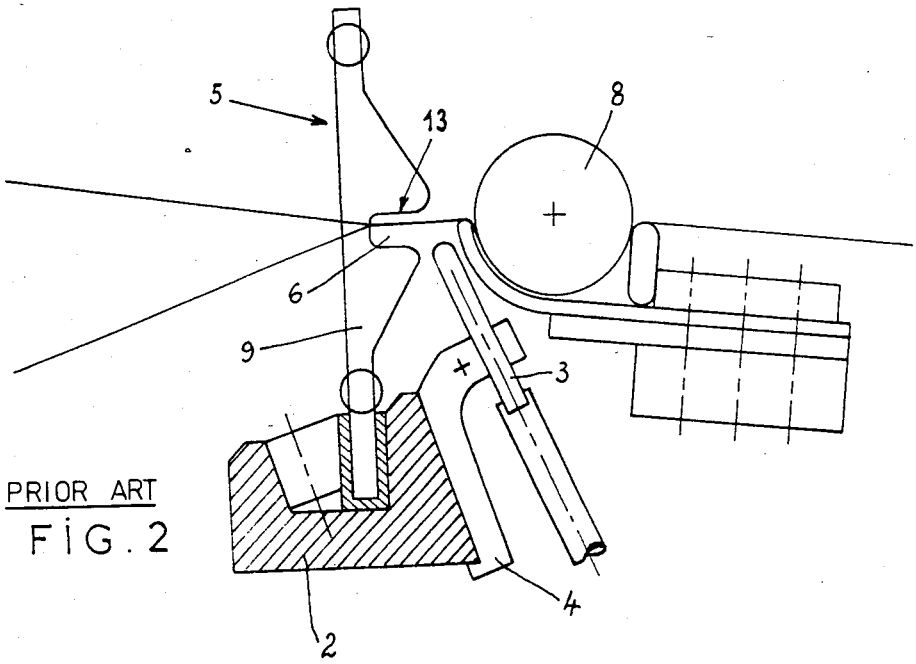
PRIOR ART FIG. 2
Figure 3:
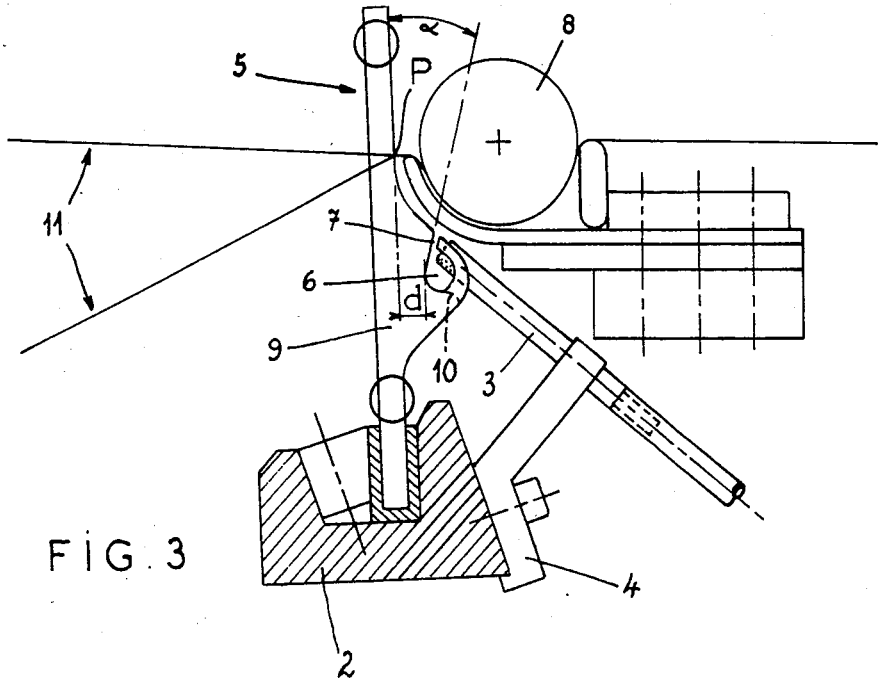
FIG. 3 is a view in cross-section of a first embodiment of the invention, the insertion channel being almost entirely closed.

A first embodiment of the reed with incorporated confiner according to the invention is diagrammatically shown in FIG. 3, where components corresponding to those in FIGS. 1 and 2 are indicated by the same reference numerals. The bottom half of each dent 9 of reed 5, at its edge facing the relay nozzles 3, has a single substantially triangular projecting part formed with a recess 6. The recess is almost completely closed except for a narrow slit 7 formed at a point on dent 9 and connecting the recess 6 to the exterior. Slit 7 extends in a direction slightly inclined forwardly at an angle ($\alpha$) to the longitudinal direction of the dent 9 so that the weft can escape upwards after insertion, during the forward motion of the battens. Recess 6 also has an offset d towards the front relative to the front straight edge of the dent 9. The dents 9 opposite the relay nozzles 3 are reduced or cutaway (as shown by a broken line 10) by eliminating the normally solid part at the front of the projecting part, between recess 6 and slit 7.

The resulting device has a recess similar in shape to that in FIG. 1, i.e. has the same advantages with regard to the cross-section of the insertion channel and the position of the beat-up point P near the temples 8, but avoids bounding the insertion channel by pointed dents offset from the reed dents, since these might catch the warp threads A comparison between FIGS. 1 and 3 also shows that if a similar U-shaped reed-holding section member 2 is used, it is easy for the weaver to change over from a cheap device with a single reed and separate confiner 1 to the device according to the invention comprising a reed with an incorporated confiner, or to make the reverse change as required. In order to use the same relay holders 4 as in FIG. 1, a block having the same thickness as the base 12 of the confiner 1 can be inserted between each holder 12 and the reed-bearing member 2 when the confiner is withdrawn in order to use the device according to the invention.

Figure 4:
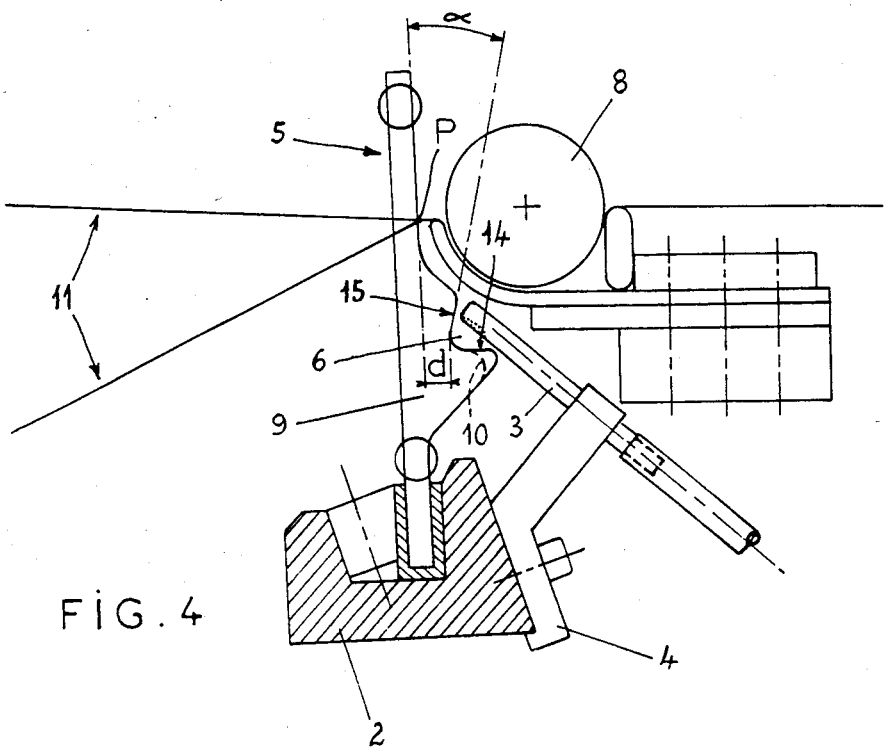
FIG. 4 is a view in cross-section of a second embodiment of the invention, the insertion channel being more widely open.

FIG. 4 shows a variant of the invention, in which the insertion channel is more open but retains the advantage of having a beating-up point P very near the temples 8. This embodiment clearly differs from the known device in FIG. 2 in that the recess 6 (no longer has an overhang 13 but has a wide opening at the top. Recess 6 is bounded by a bottom edge 14 substantially perpendicular to the longitudinal direction of tooth 9 and also by an escape edge 15 having a slight inclination ($\alpha$) relative to the longitudinal direction of the dent 9 so that the weft thread can be extracted before beating-up, during the forward motion of the batten. As before, recess 6 has an offset d towards the front relative to the front straight edge of dent 9. Opposite each relay nozzle 3, the part of the dent comprising edge 14 is reduced as shown by the broken line 10 to leave space for the end of the relay nozzle 3.

We claim:

1. A reed with an incorporating confiner for a shuttleless loom with pneumatic weft insertion, said reed having an array of transversely spaced longitudinally extending dents (9), the dents (9) of the reed (5) being formed unitarily in front of a respective front straight edge with recessed parts defining a single channel through which the weft is inserted and is drawn and guided by air jets produced by relay nozzles (3), each dent (9) of the reed (5) having a single approximately triangular projecting front part formed with a recess (6) opening upwards via a part having an escape edge (7; 15) at a slight inclination ($\alpha$) relative to the longitudinal direction of the dent (9), the recess (6) having an offset (d) towards the front relative to the front straight edge of the dent (9).

2. A reed with incorporated confiner according to claim 1, wherein the projecting part of each dent (9) formed with a recess (6) is situated in the bottom half of the dent (9).

3. A reed according to claim 1 wherein the projecting part of each dent (9) has a recess (6) which is almost entirely closed, the recess (6) opening upwards via a narrow slit (7) formed at a point on the dent (9) at a slight inclination ($\alpha$) relative to the longitudinal direction of the dent (9).

4. A reed according to claim 3 wherein on the dents (9) opposite a relay nozzle (3), the normally solid part at the front of the dent (9) between the recess (6) and the slit (7) is removed (at 10) to provide space for the end of a relay nozzle (3).

5. A reed according to claim 1, wherein the projecting part of each dent (9) has a recess (6) widely open towards the top and bounded by a bottom edge (14) substantially perpendicular to the longitudinal direction of the dent (9) and by an escape edge (15) having a slight inclination ($\alpha$) relative to the longitudinal direction of the dent (9).

6. A reed according to claim 5 wherein on the dents (9) level with a relay nozzle (3) the part of the dent (9) comprising the edge (14) of the recess (6) substantially perpendicular to the longitudinal direction of the dent (9) is reduced (at 10) to leave space for the end of a relay nozzle (3).

* * * * *